United States Patent [19]

Richardson et al.

[11] Patent Number: 4,815,875

[45] Date of Patent: Mar. 28, 1989

[54] TAPE-RIBBON CARTRIDGE AND RECEIVER TRAY WITH PIVOTED COVER AND CAM

[75] Inventors: Michael M. Richardson; Frank A. Borgeson, both of Scottsdale, Ariz.

[73] Assignee: Kroy Inc., St. Paul, Minn.

[21] Appl. No.: 151,103

[22] Filed: Feb. 1, 1988

[51] Int. Cl.[4] ..... B41J 35/28

[52] U.S. Cl. ..... 400/208.1; 220/335; 220/347; 220/306; 400/613; 400/219

[58] Field of Search ..... 400/208, 208.1, 207, 400/613, 615.2, 219, 219.1; 220/335, 347, 306, 315, 316, 324, 326

[56] References Cited

U.S. PATENT DOCUMENTS

| | | | |
|---|---|---|---|
| 3,834,507 | 9/1974 | Bradshaw . | |
| 4,226,547 | 10/1980 | Bradshaw et al. | 400/207 |
| 4,239,107 | 12/1980 | Boyatt, Jr. et al. | 400/208.1 |
| 4,243,333 | 1/1981 | Bradshaw et al. | 400/208 |
| 4,391,539 | 7/1983 | Connoy | 400/208 |
| 4,402,619 | 9/1983 | Paque et al. | 400/208 |
| 4,623,272 | 11/1986 | Kondo | 400/208 |
| 4,624,590 | 11/1986 | Richardson et al. | 400/613 |
| 4,624,592 | 11/1986 | Purcell | 400/208 |
| 4,666,319 | 5/1987 | Hirosaki et al. | 400/120 |
| 4,678,353 | 7/1987 | Richardson et al. | 400/208 |

*Primary Examiner*—Eugene H. Eickholt
*Attorney, Agent, or Firm*—Dorsey & Whitney

[57] ABSTRACT

A tape-ribbon alignment and delivery system for a thermal transfer device or the like of the type having a device housing and a transfer station including a printhead and a platen for transferring a selected image from a ribbon to a tape. The system further includes a replaceable tape-ribbon cartridge, a cartridge receiving tray connected with the device housing, a cam mechanism associated with the receiving tray for moving the cartridge into transfer alignment with the transfer station and a retaining member for retaining the cartridge in the transfer alignment position.

11 Claims, 7 Drawing Sheets

146
155
153
154
152
147
148
151
153
144
154
142
145
155
150
147
157
149
148
156
158
17
17
163
16
80
50
161
142
143
162
15
159
164
137
141
11
87
15
44
14
23
170
19
31
45
14
37
12
15
21
38
39
24
164
46
36
43
42
41
35
47
10
14
47
29
40
28
48
53
164
164
137

16
18
63
4
57
75
74
72
66
61
5
51
6
65
136
67
125
59
65
13
124
115
30
76
3
111
34
80
60
24
122
25
56
120
23
13
13
11
123
10
26
92
10
54
110
81
12
78
17
55
119
106
11
98
58
116
96
87
52
12
118
100
95
94
130
101
37
12
130
67
17
86
66
6
67
62
5
4
3
10

20
26
23
27
25
11
19
24
183
181
180
171
173
15
172
34
182
175
176
174
30
178
22
32
33
184
32
177
176
21
28
29
183
179
181

14
14
187
15
138
141
140
188
186
137
21

158
160
59
145

146
16
155
132
153
154
148
147
142
164
164
15

TAPE-RIBBON CARTRIDGE AND RECEIVER TRAY WITH PIVOTED COVER AND CAM

BACKGROUND OF THE INVENTION

The present invention relates generally to a thermal transfer device and more particularly, to a tape-ribbon supply system for a thermal device or the like in which an image of characters from a strip of color carrying ribbon is transferred to an image carrying tape as the result of the localized application of heat and pressure. The invention also relates to an improved cartridge usable with such device for supplying tape and ribbon thereto.

There are a number of strip printing or transfer type devices which currently exist in the prior art and which are utilized to transfer characters from a strip of color carrying ribbon to a strip of image carrying tape. One such device employs impact or pressure in combination with a font having raised characters to transfer an image of a selected character from a ribbon to an image receiving tape. These so-called impact or pressure lettering devices have existed since the mid-70's and are described in U.S. Pat. Nos. 3,834,507; 4,243,333; 4,402,619 and 4,624,590, among others. Cartridges for supplying tape and ribbon to these devices are described in U.S. Pat. Nos. 4,226,547; 4,391,539 and 4,678,353, among others.

Printing or transfer devices also exist in which an image of a desired character is formed onto a strip of image carrying tape by transferring ink or other color from a color carrying ribbon to such tape as a result of the localized application of heat and a small amount of pressure. A typical thermal transfer device of this type is described in U.S. Pat. No.4,666,319 dated May 19, 1987 and issued to Hirosaki et al.

A further thermal transfer device which currently exists employs a machine for transferring the image of a desired character from a strip of ribbon to a strip of tape and a cooperating tape-ribbon cartridge usable with the device for providing a supply of tape and ribbon to the machine transfer station.

Although the above described devices and corresponding cartridges may be satisfactory for various uses and applications, there is always a need to improve the quality of the image transfer, to reduce the amount of user maintenance and to improve the delivery and supply of tape and ribbon to the machine. This is particularly true with respect to thermal transfer devices in view of the fact that the proper alignment between the printhead, the platen and the tape and ribbon is of critical importance in obtaining a high quality image transfer. Accordingly, there is a continuing need for improvements in thermal transfer devices and associated cartridges and systems for supplying tape and ribbon thereto.

SUMMARY OF THE INVENTION

In accordance with the present invention, a thermal transfer device, and in particular a tape-ribbon supply system for such a device, is provided in which an image of a desired character is transferred from a strip of color carrying ribbon to a strip of image carrying tape. Generally, such a device includes a transfer station defined by a printhead and a cylindrical platen and means for advancing the tape and ribbon from a supply cartridge to the transfer station. The present invention also includes an improved system for supplying or delivering tape and ribbon to the thermal transfer device.

More specifically, the present invention relates to a tape-ribbon alignment and supply system for a thermal transfer device or the like of the type having a housing and a transfer station for tranferring a selected image from a strip of ribbon to a strip of tape. In a preferred embodiment of the system, the thermal transfer device housing is provided with a receiving or service tray for the purpose of receiving a tape-ribbon cartridge. This tray is connected with the housing in a fixed position and can comprise an integral cavity or a separately mounted tray. A tape-ribbon cartridge having a supply of tape and ribbon is designed for insertion into the receiving tray. Means are also provided for moving the inserted cartridge into proper transfer alignment relative to the transfer station. In the preferred embodiment, this means includes a pivotable cover connected to the cartridge receiving tray and a pair of cam rollers for engagement with a portion of the cartridge. Means are also provided for retaining the cartridge in proper transfer alignment and for selectively releasing the cartridge when its removal from the device is desired.

Accordingly, it is an object of the present invention to provide a thermal transfer device or the like embodying an improved tape-ribbon supply system.

Another object of the present invention is to provide an improved tape-ribbon supply system for a thermal transfer device or the like including a device housing, a tape-ribbon supply cartridge, a cartridge receiving tray or cavity and means for moving the cartridge into transfer alignment and retaining the same during a transfer step.

Another object of the present invention is to provide a thermal transfer device or the like with an improved tape-ribbon supply system for aligning a tape-ribbon supply cartridge.

These and other objects of the present invention will become apparent with reference to the drawings, the description of the preferred embodiment and the appended claims.

DESCRIPTION OF THE PREFERRED EMBODIMENT

Figures 1, 1A:
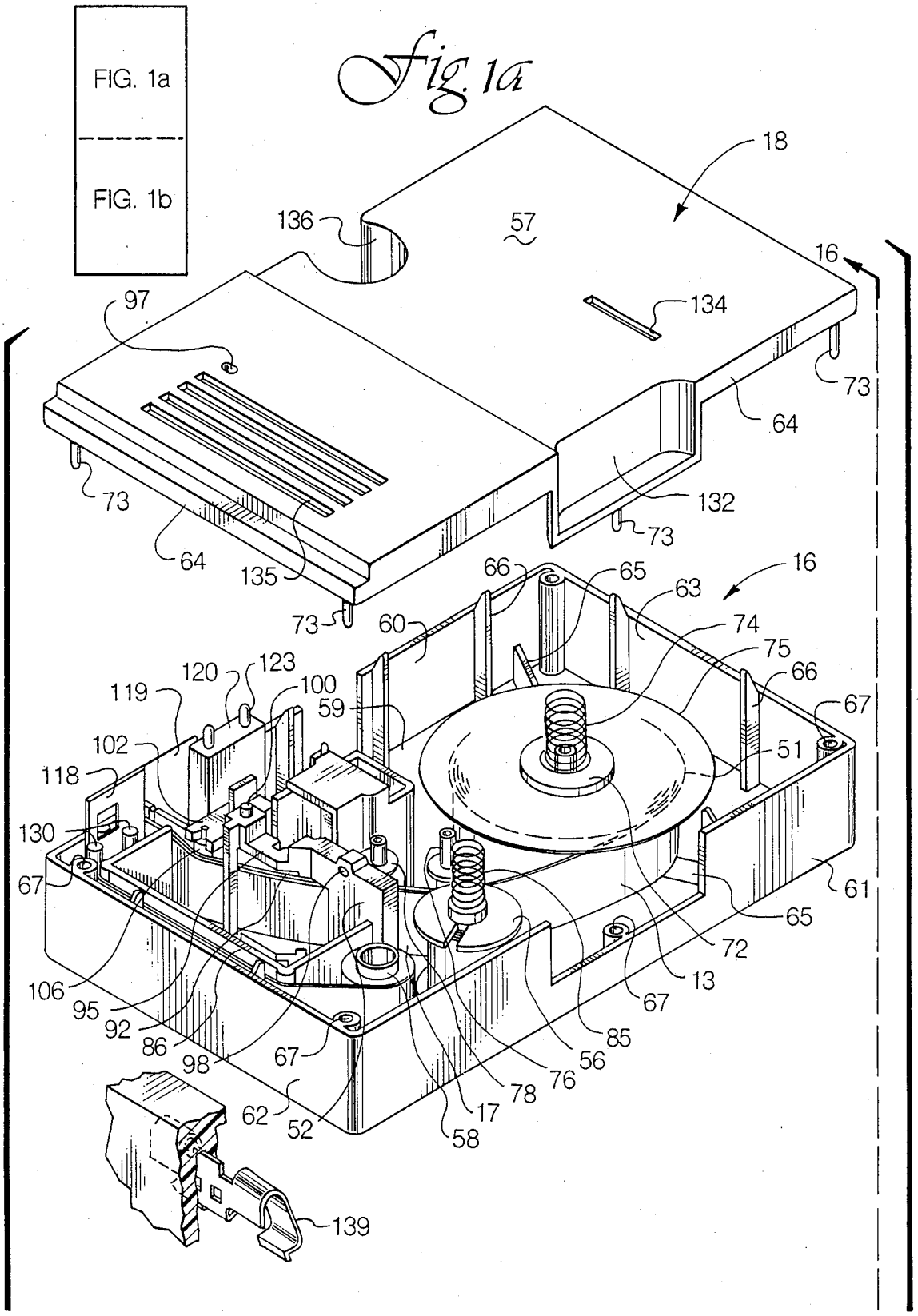
FIG. 1 is an exploded, pictorial view comprising FIGS. 1A and 1B of the thermal transfer device and cartridge of the present invention showing the machine with parts cut away, the service tray removed and suspended over the machine, the cartridge suspended over the service tray and the cartridge cover removed and suspended over the cartridge.
Figure 1B:
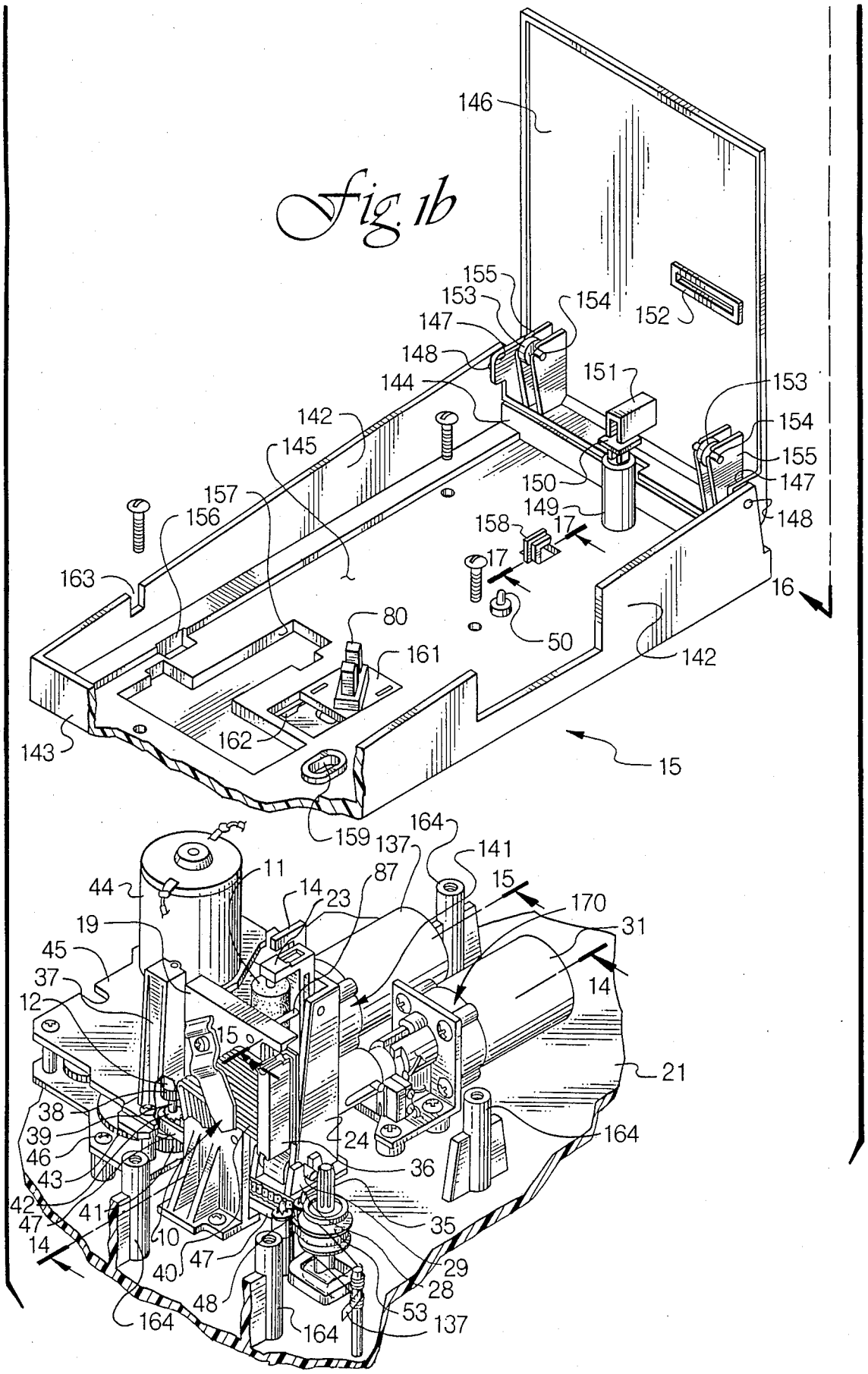

Reference is first made to FIG. 1 comprising FIGS. 1A and 1B showing an exploded pictorial view of the thermal transfer device, the tape-ribbon cartridge and the tape-ribbon supply system of the present invention. Although the preferred embodiment describes a thermal transfer device, it is contemplated that many features of the cartridge of the present invention can be used with other lettering apparatus and strip printers as well. As illustrated, the operative components of the thermal transfer device generally include a printhead assembly 10, a cooperating platen assembly comprising a cylindrical platen 11, a drive roller assembly comprising a drive roller 12, and a tape cut-off assembly comprising a tape cut-off actuating arm 14. Associated with the machine is a fixed cartridge service or receiving tray 15 and a tape-ribbon cartridge 16 for providing tape 13 and ribbon 17 to the image transfer station disposed between the printhead 10 and the platen 11. The cartridge embodies a drive roller, an alignment mechanism and an internal tape cut-off means interfaceable with corresponding components of the machine. The cartridge 16, when inserted into the tray 15, is adapted for limited movement between a first or rearward position in which the cartridge 16 is in an inoperative position and a second or forward position in which the cartridge 16 is in an operative position in alignment with the printhead.

Figure 14:
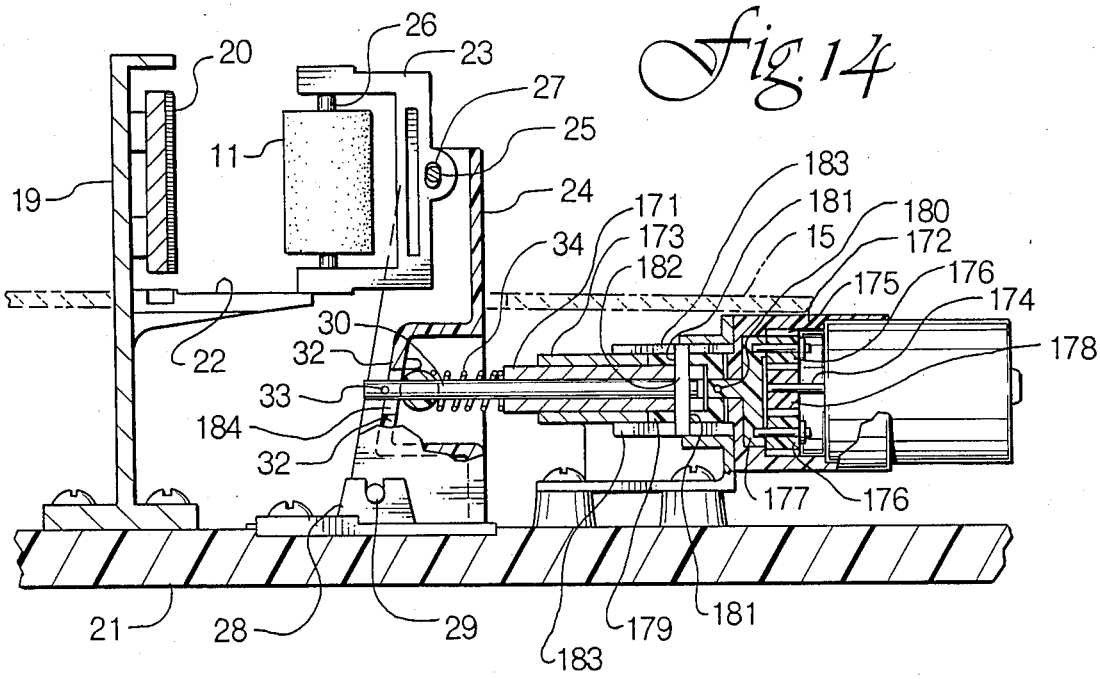
FIG. 14 is a fragmentary sectional elevation taken along line 14—14 of FIG. 16.

With specific reference to FIGS. 1B and 14, the printhead assembly 10 includes a rigid frame member 19 secured to a portion of the machine housing 21 by appropriate screws or other connecting means. The assembly 10 also includes a printhead element 20 mounted to the frame 19 for operative alignment with the platen 11. In the preferred embodiment, the printhead element 20 is a conventional thermal printhead identified by Model No. XP 86Y01 manufactured by Kyocera International, Inc. of Framingham, MA. Extending rearwardly from, and integrally connected with, a portion of the frame 19 is a horizontally disposed platen support and guide shelf 22. The shelf 22 is disposed at right angles relative to the frame 19 and functions to support the lower surface of a platen carriage 23. The platen carriage 23 is pivotally secured to a platen pivot arm 24 by a pivot pin 25 extending through the arm 24 and an opening 27 in the platen carriage 23. It should be noted that the opening 27 in the carriage 23 is elongated in the vertical direction to permit limited vertical movement of the carriage relative to the pivot 25. The carriage 23 includes a pair of forwardly extending spaced platen support portions which rotatably receive the center rotation shaft 26 of the cylindrical platen 11.

The platen arm 24 extends generally vertically upwardly from, and is pivotally connected to, a base 28 about the pivot pin 29. The base 28, in turn, is securely connected to a portion of the housing 21. The pivot pin 29 extends generally parallel to the pivot pin 25 and permits limited counterclockwise and clockwise rotation of the arm 24, and thus corresponding forward and rearward movement of the platen 11, respectively.

As shown best in FIG. 14, a drive rod 30 extends forwardly from a linear actuator mechanism 170 and through an elongated opening formed in a wall portion 32 of the arm 24. Means in the form of a pin or some other stop member 33 is connected with the forward end of the rod 30 to keep the rod 30 in engagement with the arm 24. A bearing member 184 engages a portion of the arm 24 to assist in transferring movement of the rod 30 to the arm 24. A spring 34 is disposed between a rearward portion of the bearing 184 and a forward end portion of a drive pin 171 to bias the arm 24 in a counterclockwise or forward direction against the stop member 33.

In the preferred embodiment, the linear actuator 170 includes a motor 31 and a reduction gear and linear conversion assembly for converting the rotational movement of the motor shaft 174 to generally linear movement of the drive rod 30. Such assembly includes a gear housing 172 and a linear conversion housing 173. Formed within the housing 172 is a ring gear 175 and a pair of planet gears 176, 176. The gears 176, 176 are rotatably mounted to a planet carrier 177 which is positioned to engage the ring gear 175. A sun gear 178 is connected to the end of the motor shaft 174 for engagement with each of the planet gears 176. Rotation of the motor shaft 174, and corresponding rotation of the sun gear 178, results in rotation of the planet gears 176. This in turn causes revolvement of the planet gears 176 about the gear 178 as a result of engagement with the ring gear 175. Such revolvement results in corresponding rotational movement of the planet carrier 177. With the structure illustrated in FIG. 14, an output reduction of about 4.8 to 1 is achieved.

A forward output shaft of the planet carrier 177 is connected for common rotation with a drive screw 179 via a cross pin 180. The drive screw 179 is provided with a double helix guide ramp 181 which engages a cross pin 182 extending through a drive pin 171. The outer ends of the cross pin 182 extend through the double helix slot 181 for engagement with a guide and retaining slot 183 in both the top and bottom portions of the housing 173 to guide the forward and rearward movement of the cross pin 182 and prevent rotation of the pin 182 and thus the drive pin 171. With the above described structure, rotation of the motor shaft 174 causes corresponding rotational movement of the planet carrier 177 and the drive screw 179 via the reduction gear members 175, 176 and 178. Rotation of the drive screw 183, in turn, results in linear movement of the drive pin 171 and thus the rod 30. In the preferred embodiment, the motor 31 is capable of selective movement in both directions, thus providing the capability of selectively moving the rod 30 in either a forward or a rearward direction.

Such movement of the rod 30 causes corresponding counterclockwise or clockwise pivoting of the arm 24. During operation, as the rod 30 is extended and the arm 24 pivots in a counterclockwise direction, the platen 11 moves in a forward direction toward the printhead 20. Continued forward movement of the rod 30 results in engagement between the platen 11 and the rearward surface of the tape which is positioned between the platen 11 and the printhead element 20. When this occurs, further forward movement of the rod 30 will not result in any further movement of the platen 11. Instead, the platen will be biased against the rearward surface of the tape by the force of the spring member 34. With this mechanism, a relatively constant force is generated between the printhead element 20 and the platen 11, which force is determined by the spring 34.

The platen 11 is a generally cylindrical member constructed of a rubber-like material. In the preferred embodiment, the platen 11 is constructed of a urethane material having a durometer of about 40 (plus 10, minus 0) on the Shore A scale. During forward movement of the platen 11, the bottom portion of the carriage 23 rides on the platen shelf 22 to insure proper vertical positioning of the platen 11.

Also associated with the printhead assembly 10 is an electrical connector element 36 and a plurality of electrical leads 40 extending from the connector 36 to a control means (not shown). The control means functions to drive the printhead assembly 10.

Figure 5:
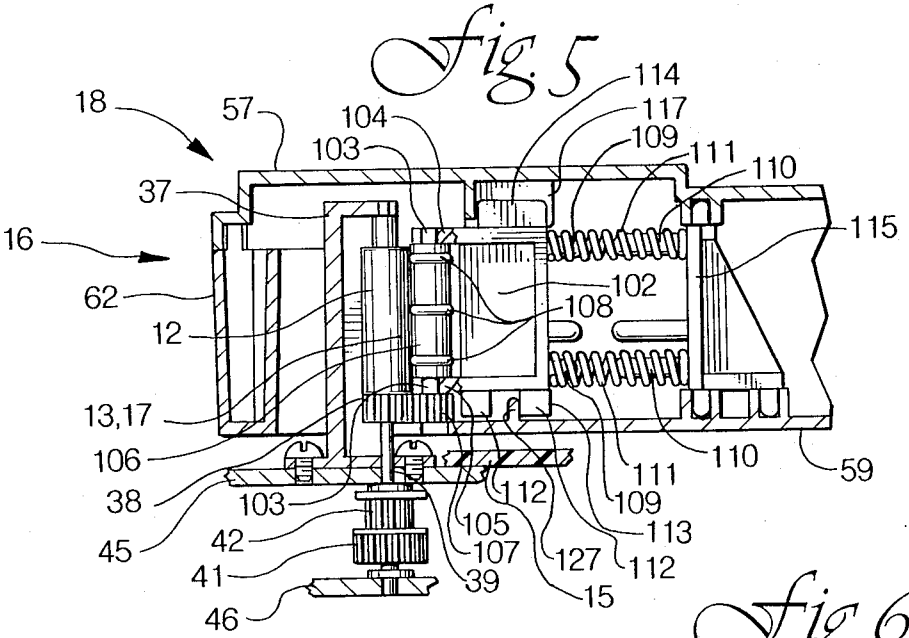
FIG. 5 is a fragmentary sectional elevation of the tape-ribbon drive feature taken along the section line 5—5 of FIG. 2.

As illustrated best in FIGS. 18 and 5, the tape-ribbon drive assembly includes a drive roller 12 rotatably mounted within a drive roller housing 37 with the top end of the drive roller 12 journalled in an upper end of the housing 37. Adjacent to the lower end of the roller 12 is a drive gear 38 which, during operation, is designed for meshing engagement with a corresponding drive gear 107 associated with the cartridge drive roller 106. The drive roller shaft 39 which extends downwardly from the drive roller shaft 39 which extends downwardly from the drive roller 12 and the drive gear 38 is connected with a lower toothed gear 41. The gear 41 is connected via a gear assembly 43 comprising a plurality of gears to a motor 44. Rotation of the motor 44 drives the gear assembly 43 which rotates the gear 41 and thus the drive roller 12. As will be more fully described below, rotation of the drive roller 12 causes corresponding rotation of the drive roller 106 (FIG. 5) as a result of engagement between the gears 38 and 107. Such rotation drives the tape and ribbon through the system.

In the preferred embodiment, the drive assembly housing 37 is rigidly secured to a top frame 45 which is spaced from a lower frame member 46. The frame members 45 and 46 are rigidly secured to the machine housing 21 by appropriate threaded members and are retained in a spaced relationship by a plurality of spacing posts.

A ribbon rewind shaft 35 includes an upper splined rotatable end and a lower end which is pivotally and rotatably mounted within a portion of the machine housing 21 to permit limited forward and rearward tilting of the shaft 35. A gear 53 connected with the splined shaft 35 is driven by an endless belt 47 which extends around a pair of idler gears 48, 48 and to the gear 42 on the lower end of the shaft 39. With the above structure, the splined shaft 35 is rotated along with rotation of the drive roller 12. It should be noted that the shaft 35 is mounted in the housing 21 to permit not only rotational movement, but also limited forward and rearward pivoting movement. This enables the splined portion of the shaft to engage the ribbon rewind spool and also to accommodate the limited forward movement of the cartridge after such engagement. A torsion spring member 137 biases the rewind shaft 35 in a rearward direction.

Figure 6:
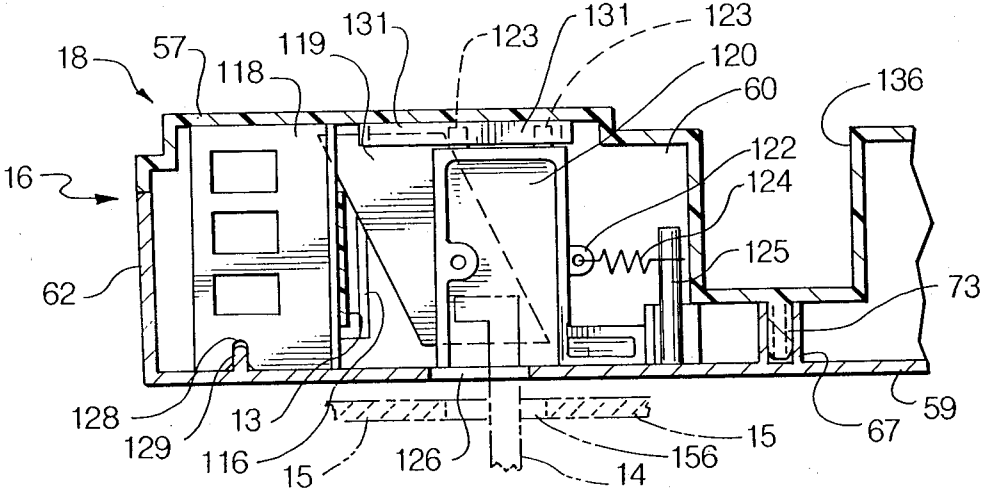
FIG. 6 is a fragmentary sectional elevation of the tape cut-off feature taken along the section line 6—6 of FIG. 2.
Figure 15:
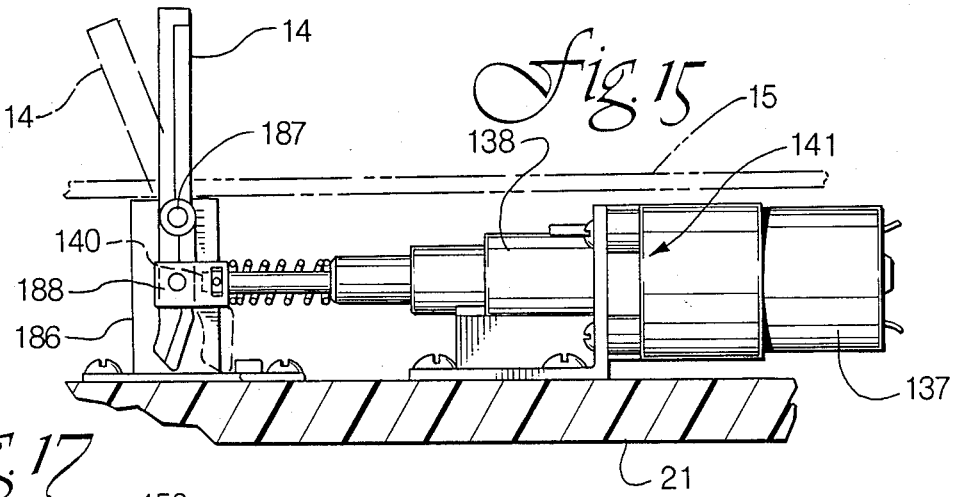
FIG. 15 is a fragmentary sectional elevation taken along section line 15—15 of FIG. 16.

The tape cut-off actuating mechanism is illustrated best in FIGS. 6 and 15. The cut-off actuating arm 14 is pivotally secured at an intermediate point to a yoke member 186 about the pivot 187. The yoke 186 is in turn secured to the machine housing. The arm 14 includes an upper end which extends upwardly through an opening 156 in the tray 15 and an opening 126 in the cartridge bottom 59 for engagement with a portion of the blade mount 120 within the cartridge. The lower end of the arm 14 is connected via a clevis member 188 with the drive rod 140 of a linear actuator mechanism 141. The mechanism 141 is secured to the bottom of the machine housing 21 by appropriate fastening means. In the preferred embodiment the mechanism 141 includes a motor 137 and a reduction gear and linear conversion assembly 138 which are similar to corresponding elements of the platen actuator illustrated in FIG. 14. The only exception is that the reduction gear assembly 138 comprises a two stage reduction gear assembly providing a 23 to 1 output reduction as compared to a 4.8 to 1 output reduction for the platen actuator. Selective actuation of the motor 137 causes forward or rearward or movement of the rod 140 and thus corresponding rearward or forward movement of the upper end of the arm 14 and blade mount 120. Rearward movement of the rod 140 (movement to the left as viewed in FIG. 15) causes corresponding forward movement of the mount 120 and blade 119 to cut the tape in the manner which will be described in greater detail below.

The cartridge receiving or service tray 15 is illustrated best in FIG. 1B. As shown, the tray includes a bottom surface 145, a pair of side walls 142, 142, a front edge 143 and a rear edge 144 which together define a cartridge receiving cavity. Pivotally connected to a rearward end of the side walls 142, 142 is a service tray cover 146. The cover 146 includes a pair of connection tabs 147. Each of the tabs 147 includes a pivot post 148 which extends through a corresponding pivot opening in the side walls 142 to pivotally secure the cover 146 relative to the tray 15.

The tray 15 also includes an upstanding post 149 and a spring biased plunger 150 partially contained within the post 149 and biased in an upward direction via a spring member also contained within the post 149. A cam member 151 integrally formed with a portion of the cover 146 is adapted for engagement with the spring biased plunger 150. The cam member 151 is shaped so that if the cover 146 is open, the plunger 150 will tend to keep it open, while if the cover 146 is closed, the plunger 150 will tend to keep it closed. A tape viewing slot 152 is formed in the cover 146 and is aligned with a corresponding tape viewing slot 134 in the cover portion of the cartridge (FIG. 1A).

Figure 16:
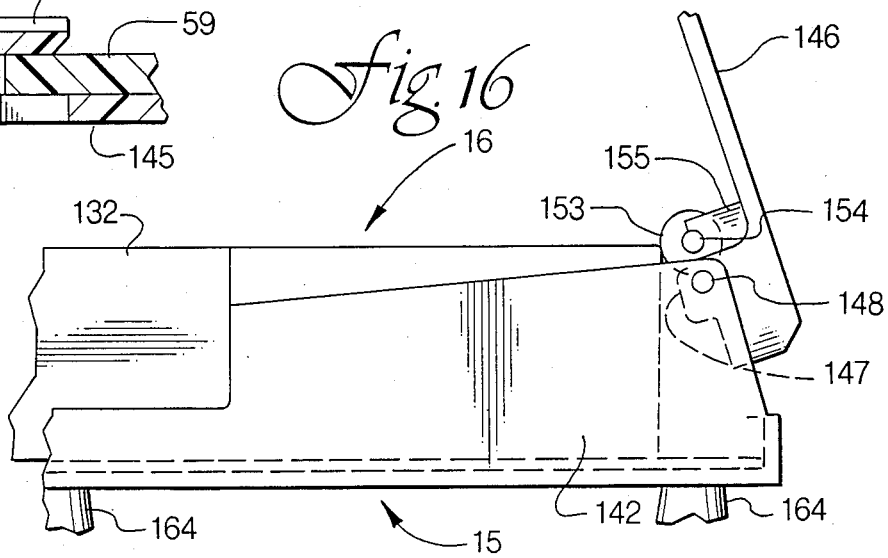
FIG. 16 is a fragmentary detail view taken along the section line 16—16 of FIG. 1A and FIG. 1B showing selected parts therefrom in assembly.

A pair of cam rollers 153 are rotatably secured to the inside rear surface of the cover 146. Each of the rollers 153 is supported on a shaft 154 which is in turn supported by an appropriate roller mount 155. As illustrated best in FIG. 16, these rollers 153 cause the cartridge 16 to move forwardly into an operational position as the cover 146 is closed. Such movement of the cartridge is the result of engagement between the rollers 153 and a rearward portion of the cartridge 16.

A return spring 139 is connected with a forward portion of the machine cover and adapted to bias the cartridge 16 rearwardly. Thus, when the cover 146 of the tray 15 is opened, the spring 139 acts against the forward end of the cartridge and causes it to move rearwardly so that it can be removed from the machine.

Figure 17:
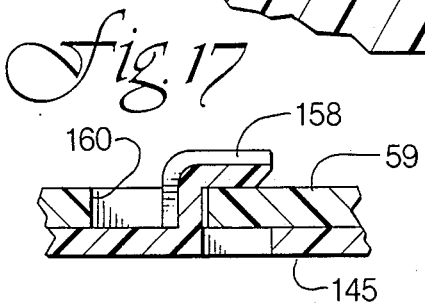
FIG. 17 is a detail section taken along the section line 17—17 of FIG. 18.

The bottom 145 of the service tray 15 includes an opening 156 to accommodate the tape cut-off arm 14, an opening 157 to allow the printhead and platen assemblies to extend through the tray 15 and into operational relationship with the cartridge and an opening 159 to allow the splined shaft 35 to extend into the cartridge. A retaining tab 158 extends upwardly and rearwardly from the bottom 145 to retain the cartridge in a fixed operative position. As illustrated best in FIG. 17, the bottom 59 of the cartridge includes an opening 160 which, when the cartridge is inserted into the service tray 15, is positioned over the retaining tab 158 so that the member 158 extends into the interior of the cartridge. Then, as the cartridge 16 is moved forward as a result of closing of the cover 146, a portion of the cartridge bottom 159 is retained by the overhanging portion of the tab 158.

Also mounted to the service tray bottom 145 is a tape sensing means 80. In the preferred embodiment, the means 80 is mounted onto a slide 160 which is adapted for limited forward and rearward sliding movement relative to the bottom 145 of the service tray 15. The slide 161 is guided by a plurality of slots 162 and is biased by an appropriate spring member in a rearward direction. The service tray 15 is rigidly secured to the housing 21 via a plurality of screws extending through the tray 15 and into a plurality of corresponding tray support posts 164 (FIG. 1B).

Figure 2:
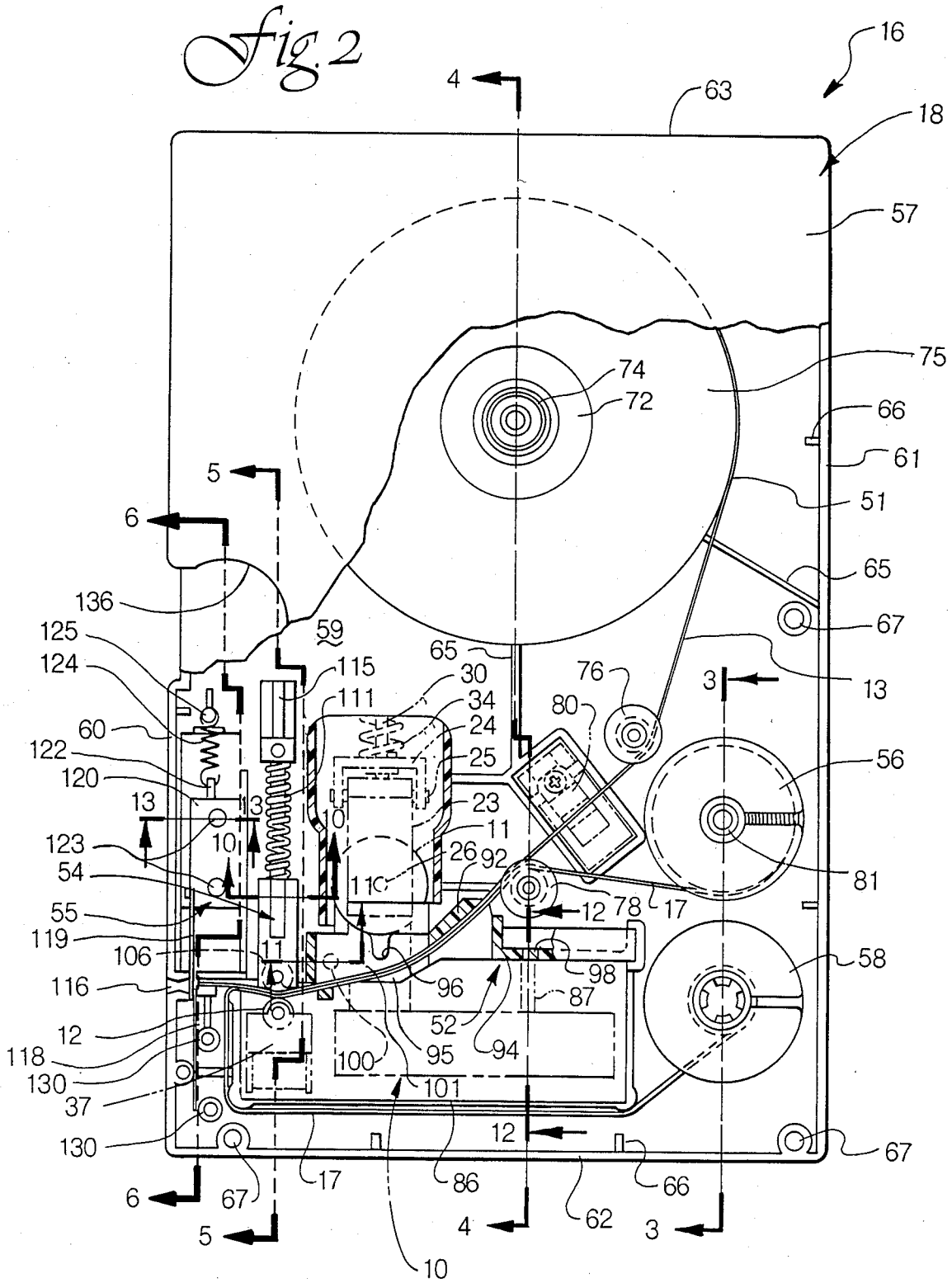
FIG. 2 is a top plan view of the tape-ribbon cartridge of the present invention with the cover removed and parts cut away.

As illustrated generally in FIGS. 1A and 2, the tape-ribbon cartridge 16 of the present invention includes a spool of tape 51 for supplying tape 13 to the image transfer station, a pair of ribbon supply and rewind spools 56 and 58, respectively, for providing ribbon 17 to and withdrawing ribbon from the image transfer station and a floating tape guide and alignment member 52 for properly aligning the tape and ribbon 13 and 17 and the platen 11 with respect to the printhead 10. The cartridge 16 also includes a spring biased tape-ribbon drive mechanism illustrated generally by the reference numeral 54 and an internal tape cut-off mechanism illustrated generally by the reference numeral 55.

The cartridge 16 is generally rectangular in configuration and, in addition to the cover 18, includes a bottom surface 59, a pair of side walls 60 and 61 and a pair of end walls 62 and 63. The cartridge housing is reinforced by a plurality of reinforcing ribs 65 integrally formed with the bottom 59 and reinforcing ribs 66 integrally formed with the walls 60–63. The cover 18 includes a top surface 57 and four walls 64 which mate with the side and end walls 60–63. The cartridge base includes a plurality of alignment and retaining openings 67 to mate with corresponding alignment and retaining posts 73 formed in the cover 18. When assembled, the top surface 57 of the cover 18 and the bottom surface 59 are generally parallel to one another.

Figures 3, 4, 8, 9:
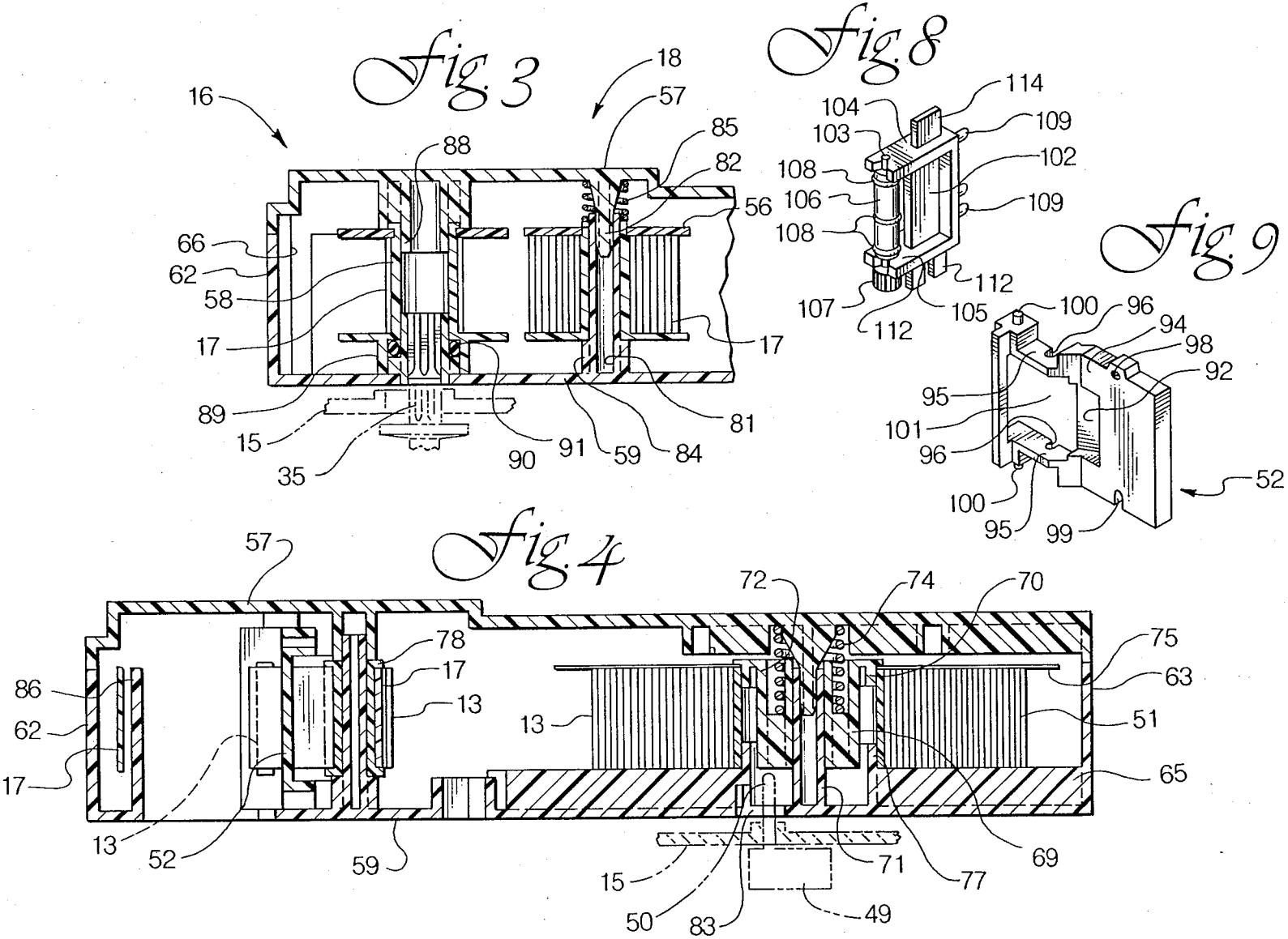
FIG. 3 is a fragmentary sectional elevation of the ribbon supply and rewind spools taken along the section line 3—3 of FIG. 2.
FIG. 4 is a sectional elevation showing a portion of the floating tape-ribbon guide member and the ribbon supply spool as taken along the section line 4—4 of FIG. 2.
FIG. 8 is a pictorial view of a portion of the tape-ribbon drive assembly embodied within the cartridge of the present invention.
FIG. 9 is a pictorial view of the floating tape-ribbon guide member disposed within the tape-ribbon cartridge of the present invention.

As shown best in FIGS. 1, 2 and 4, the tape supply spool 51 is mounted on a central cardboard cylinder 68. The inner surface of the cylinder 68 is supported and retained by an annular portion 70 of a plastic hub 69 and a cylindrical support 77 integrally formed with the bottom 59. The hub 69 includes a centrally positioned opening for rotatably mounting the hub 69 relative to the post 71. The post 71 is integrally formed with and is generally perpendicular to the cartridge bottom 59. The spool 51 is supported on the top edges of the reinforcing ribs 65 as shown in FIG. 4. A coil spring 74 has one end in engagement with an annular recess 72 within the hub 69 and its other end in engagement with the top surface 57 of the cover 18. This spring 74 functions to keep the spool 51 in contact with the reinforcing ribs 65 and exerts a frictional force against the hub 69 to provide the desired drag or resistance to rotation of the spool 51. A disc member 75 is disposed on the top side of the spool 51 with its inner edge positioned between an edge of the cardboard cylinder 68 and a portion of the hub 69 to assist in maintaining the spool 59 in a compact configuration.

As shown in FIG. 4, the bottom of the hub 69 extends into the interior of the cylindrical support 77 for cooperation with a stem 50 of a microswitch 49 mounted to the service tray 15. The stem 50 extends upwardly from the tray 15 and through an opening 83 in the cartridge bottom 59 for possible engagement with the bottom of the hub 69. Because of the width of the tape on the spool 59 shown in FIG. 4, the hub 69 is precluded from contacting the stem 50. However, if a narrower tape is used, the hub 69 will engage and depress the stem 50, thereby activating the microswitch 49. This information regarding tape width in turn is communicated to the machine user and to the other processing circuitry in the machine to indicate width of tape in the cartridge.

Upon leaving the spool 51, the tape 13 is guided by a pair of flanged guide or idler rollers 76 and 78 (FIG. 2) past a tape sensing opening 79 in the cartridge bottom 59 and toward the tape alignment member 52. The opening 79 provides access for a tape sensing mechanism 80 associated with the service tray 15. In the preferred embodiment, the tape sensing mechanism 80 includes a pair of members which extend upwardly through the opening 79 with one portion on either side of the tape 13. The tape sensing mechanism 80 electronically determines whether tape exists in the system and warns the user that the tape is exhausted by sending an appropriate signal to a warning device such as a light or buzzer (not shown).

As illustrated best in FIGS. 1A and 3, a color or ink carrying ribbon 17 is supplied from a ribbon supply spool 56. The spool 56 is rotatably mounted on a post 81 which is integrally formed with the bottom 59 of the cartridge and extends upwardly for engagement with a corresponding ribbon spool alignment post 82 formed with the top 57. The ribbon spool 56 is supported on an enlarged annular portion 84 of the post 81 and is retained in such position by a coil spring 85 disposed between the top 57 and a top portion of the spool 56. The spring 85 performs both a function of maintaining the spool 56 in a proper vertical orientation against the annular portion 84 to prevent the ribbon spool 56 from freewheeling and providing the desired tension in the ribbon 17 supplied to the transfer station.

After leaving the supply spool 56, the ribbon 17 is guided past the guide roller 78 for engagement with the tape-ribbon guide member 52. After the printing or transfer step at the transfer station, the ribbon 17 is stripped or separated from the tape 13 as a result of being directed around a ribbon guide wall or surface 86 for rewinding onto the ribbon rewind spool 58. The ribbon rewind spool 58 includes an upper cylindrical opening for cooperation with a rotation post 88 and a lower annular portion 89 for engagement with the cartridge bottom 59. The spool 58 also includes a clutch means providing an internal, splined drive member 90 and an O-ring 91 disposed between the member 90 and the spool for the purpose of transferring a desired torque from the member 90 to the spool 58. This creates a desired tension in the ribbon being rewound. In the preferred embodiment, a splined shaft 35 extends upwardly from the machine and into the cartridge for engagement with the splined member 90. During printing operation of the machine, the shaft 35 rotates continuously, thus causing corresponding continuous rotation of the internal splined member 90 and corresponding continuous exertion of a rewind force or torque on the spool 58. The size of this rewind force is determined by the relationship between the element 90, the O-ring 91 and the spool 58. In the preferred embodiment, to achieve optimum print quality, the structure is designed to create a torque on the ribbon rewind spool 58 such that approximately 1½to 4 ounces of tension are created in the ribbon being rewound.

As illustrated generally in FIGS. 1A and 2, and more specifically in FIG. 9, the floating tape-ribbon guide member 52 includes a generally rigid frame 94 comprising a pair of top and bottom edges and a pair of side edges to define an opening 101. The opening 101 facilitates operative engagement between the printhead 10 and platen 11 as shown best in FIG. 2. The point at which the printhead 10 and platen 11 are operatively engaged defines the transfer station. A guide surface 92 extends between top and bottom edge portions of the frame 94 to guide the ribbon 17 and tape 13 toward the transfer station. A pair of yoke members 95 define a portion of the top and bottom edges of the frame 94 and extend laterally in the area of the transfer station to receive the platen 11. Each of the yoke members 95 includes a recessed portion 96 to receive the rotational shaft 26 of the platen 11.

One side edge of the frame 94 includes a pair of alignment openings 98 and 99 for interfacing with corresponding alignment pins 87, 87 (FIG. 12) of the printhead 10. In the preferred embodiment, the alignment opening 98 is a cylindrical opening having an axis generally perpendicular to the axis of rotation of the platen 11. The alignment recess 99 has a generally U-shaped configuration which opens downwardly. The other side edge of the frame 94 includes an alignment post 100 extending outwardly from the top and bottom surfaces of the frame 94. In FIG. 9, only the post 100 extending from the top edge can be seen. The post extending from the bottom edge, however, is identical except that it extends in the opposite direction. As noted, each of the posts 100 extends in a direction generally parallel to the axis of rotation of the platen 11.

Figure 11:
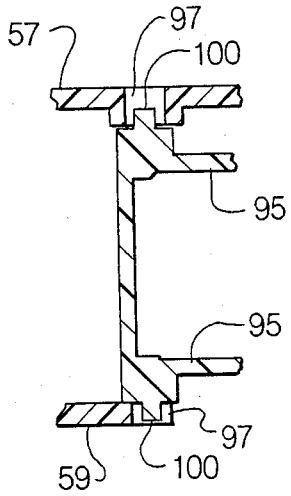
FIG. 11 is a fragmentary sectional elevation taken along the section line 11 of FIG. 2.

As illustrated best in FIG. 11, the top 57 and bottom 59 of the cartridge are provided with corresponding alignment openings 97 to receive the posts 100. In the preferred embodiment, each of the openings is elongated in a direction generally parallel to the travel path of tape 13 past the transfer station to permit alignment of the guide member 52 relative to the printhead 10, but to prevent movement of the member 52 in a forward or rearward direction. As shown in FIG. 2, the guide member 52 is also retained by a retaining member 73 connected with the cartridge bottom 59. A similar retaining member is embodied in the top surface 57 of the cover 18 to retain the top of the guide member 52. The retaining members 73 preclude forward and rearward movement of the member 52.

Figure 12:
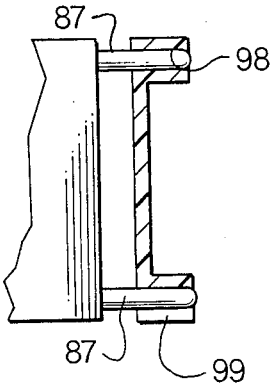
FIG. 12 is a fragmentary sectional elevation taken along the section line 12—12 of FIG. 2.

With the above structure, the guide member 52 is retained in a plane generally parallel to the printhead plane. Thus, forward and rearward movement is prevented by the alignment means comprising the posts 100 and the corresponding openings 97 and by the alignment means comprising the retaining members 73. Limited aligning movement of the guide member 52 within this plane, however, is permitted because of the shape of the openings 97 (FIG. 11) and the opening 99 (FIG. 12). The final alignment between the member 52 is controlled by engagement between the pins 87 and the openings 98 and 99.

The guide member 52 is utilized to accurately align not only the tape and ribbon relative to the printhead 10 and the transfer station, but to also accurately align the platen 11 relative to the printhead 10. The guide member 52 functions to align the platen 11 as a result of engagement between the alignment recesses 96 in the yoke members 95. It should be noted, however, that the recessed portions 96 are also elongated in a direction generally perpendicular to the printhead plane. Thus, the yoke members 95 and recesses 96 define the position of the platen axis in a plane generally parallel to the printhead plane, but permits limited movement and tilting of the axis in a plane generally perpendicular to the printhead plane. This allows the platen axis to be aligned in a forward and rearward direction as a result of engagement between the platen 11 and printhead 10, with tape and ribbon positioned therebetween. The above described alignment between the platen and the printhead facilitates optimum and consistent print quality.

Positioned immediately downstream from the transfer station is the means for advancing the tape and ribbon through the system, namely, the drive assembly 54. As illustrated best with reference to FIGS. 1A, 2 and 5, the drive assembly 54 includes a yoke member 102 having top and bottom yoke elements, 104 and 105, respectively. These elements 104 and 105 extend forwardly to rotatably receive a drive roller 106. The drive roller 106 is mounted to a roller shaft 103 whose opposite ends are journalled in the yoke elements 104 and 105. As illustrated best in FIG. 5, the exterior cylindrical surface of the roller 106 is provided with a plurality of rubber O-rings 108 to assist in gripping the back side of the tape 13 and advancing the same as the roller 106 is rotated. The lower end of the shaft 103 extends through the bottom yoke element 105 and is connected with a toothed gear 107. The gear 107 is adapted for operative engagement with a corresponding toothed gear 38 at the lower end of the drive roller 12. Because of the engagement between the toothed gears 107 and 38, both of the rollers 106 and 12 are driven rollers.

Figure 10:
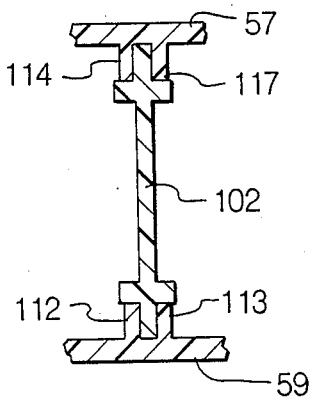
FIG. 10 is a fragmentary sectional elevation taken along the section line 10—10 of FIG. 2.

The yoke 102 is mounted within the cartridge to permit limited forward and rearward movement of the yoke 102. This limited movement is facilitated by a pair of tabs 112 extending downwardly from the bottom of the yoke 102 and a tab 114 extending upwardly from the top of the yoke 102. As shown best in FIG. 10, these tabs 112 and 114 are guided in guide channels 113 and 117 in the bottom and top of the cartridge, respectively. The forward movement of the yoke is limited by engagement between one of the tabs 112 and the stop 127 (FIG. 5). Connected to the rearward surface of the yoke 102 are a pair of posts 109 which are aligned with corresponding posts 110 extending forwardly from a fixed member 115. The member 115 is fixedly secured between the bottom 59 and top 57 of the cartridge by a plurality of retaining posts and corresponding recesses. A pair of springs 111 are connected with the corresponding pairs of opposed posts 109 and 110 in the manner illustrated in FIG. 5 to bias the yoke 102 and thus the drive roller 106 in a forward direction. This bias in the forward direction results in a tape-ribbon advancement force being exerted toward the drive roller 12 of the machine.

When a tape and ribbon are disposed between the drive rollers 106 and 12, the tape 13 and ribbon 17 are driven through the system as a result of the force exerted by the springs 111 and the rotation of the rollers 106 and 12 via the gears 107 and 38. It should be noted that in the preferred embodiment, the O-rings 108 in the roller 106 are dimensioned so that approximately 50% of the drive force exerted against the back side of the tape is taken up by the steel portion of the roller 106.

Figure 7:
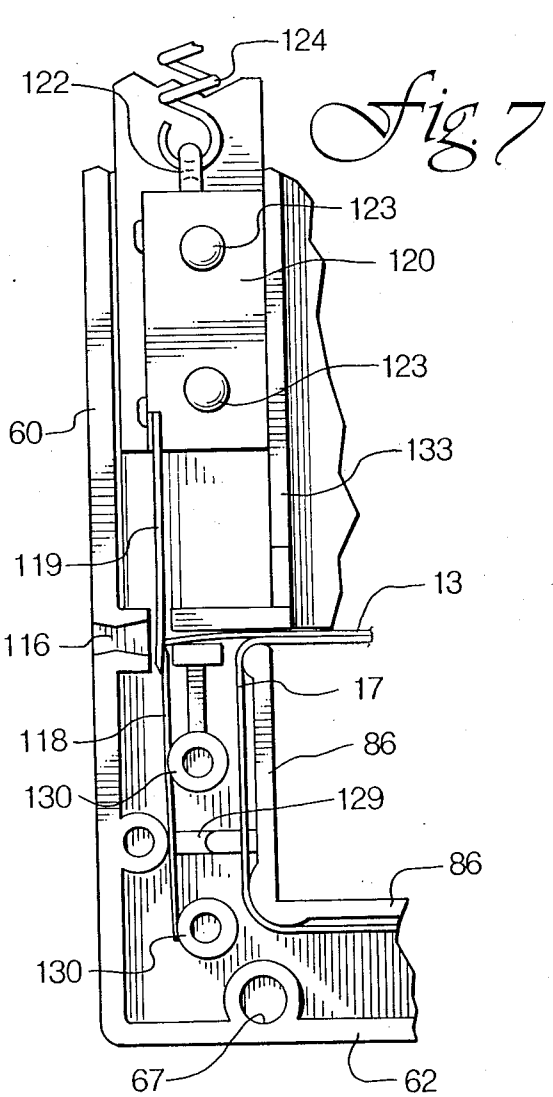
FIG. 7 is an enlarged detail of the tape cut-off feature.

After the tape 13 and ribbon 17 have passed through the drive rollers 106 and 12, the tape extends in a generally straight path through an opening 116 (FIGS. 2 and 7) in the side wall 60 of the cartridge and a corresponding opening 163 in the tray 15. Positioned immediately inside the opening 116 is an internal tape cut-off assembly 55 which is embodied entirely within the cartridge. The cut-off assembly 55 is illustrated best in FIGS. 1, 2, 6 and 7 and includes a pair of blades 118 and 119 positioned within the cartridge housing in a side-by-side, shearing position as shown best in FIGS. 2 and 7. The blade 118 is secured within the cartridge in a fixed position with its cutting edge extending generally perpendicular to the top and bottom surfaces of the cartridge 16. The blade 118 is retained in this fixed position by engagement between a recessed portion 128 and an alignment rib 129 integrally formed with the bottom 59 of the cartridge and by a plurality of retaining posts 130.

Figure 13:
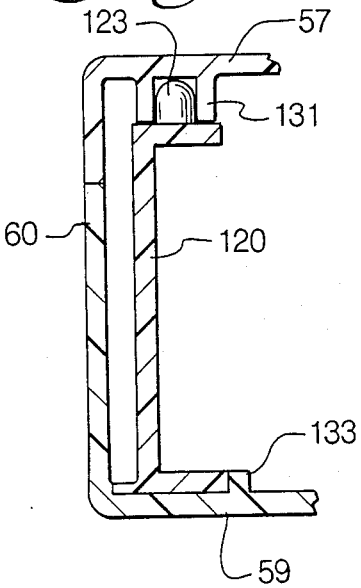
FIG. 13 is a fragmentary sectional elevation taken along line 13—13 of FIG. 2.

The blade 119 is also disposed within the cartridge and includes a cutting edge which is beveled relative to the top 57 and bottom 59 surfaces of the cartridge. The blade 119 is fixed to the blade mount 120 which is adapted for limited forward and rearward sliding movement within the cartridge. This movement is in response to corresponding forward and rearward movement of the cut-off arm 14 extending upwardly from the machine. As illustrated best in FIG. 6, the cut-off arm 14 extends upwardly through an opening 156 in the tray 15 and an opening 126 in the bottom 59 of the cartridge and has a forward end adapted for engagement with a portion of the blade mount 120. As shown in FIG. 13, the top edge of the mount 120 is provided with a pair of guide posts 123 which are guided by a guide groove 131 integrally formed with the top surface 57 of the cover 18. The bottom edge of the mount 120 is guided by the guide groove 133. A spring 124 is connected between a spring connecting tab 122 on the mount 120 and a fixed post 125 to bias the blade mount 120, and thus the blade 119, in a rearward direction.

Because of the force exerted by the spring 124, the normal position of the blade mount 120 and blade 119 is in the position illustrated in FIG. 6. When the cutter arm 14 is actuated, the arm 14 moves in a forward direction causing the mount 120 and the blade 119 to move toward the left as viewed in FIG. 6, thus cutting the tape. Upon release of the force driving the arm 14, the spring returns the blade 119 to the position shown in FIG. 6.

The cover 18 of the cartridge 16 is shaped to conform generally to the lower portion of the cartridge and includes a pair of recessed gripping portions 132 and 133 (FIG. 1) to facilitate easy gripping of the cartridge. A tape viewing slot 134 is also provided in the cover to permit viewing of the tape within the cartridge. This permits the user to determine the approximate amount of tape left in the cartridge. The forward end of the cover 18 includes a plurality of vent slots 135 to dissipate heat generated by the printhead during operation. A rearward portion of the cover 18 defined by the shoulder 170 is reduced in thickness to receive the tray cover 146 in its closed position.

Having described the structure of the present invention in detail, the operation of the thermal transfer device and the corresponding tape-ribbon cartridge of the present invention can be described as follows. First, with the cover 146 of the cartridge service tray 15 in its open position, the cartridge is manually inserted into the receiving cavity of the tray 15. In this position, the microswitch stem 50 which extends upwardly from the surface of the tray 15 extends through the opening 83 in the bottom of the cartridge for possible engagement with a corresponding reference surface of the hub 69. Because the position of this reference surface varies with the width of tape within the cartridge, the position of the microswitch stem 50 relative to such reference surface will reflect the width of tape within the cartridge. Also, as the cartridge is placed into the service tray 15, the tape detecting mechanism 80 will extend upwardly through the opening 79 to detect whether or not tape exists within the cartridge. The retaining tab 158 will also extend through the opening 160 (FIG. 17) and the printhead and platen assemblies, the cut-off arm 14 and the ribbon rewind shaft 35 will extend through corresponding openings in the cartridge bottom.

After the cartridge has been placed within the service tray 15, the cover 146 is closed by moving it forwardly and downwardly. During this movement, the camming action resulting from the cam surfaces 153, 153 against the rearward edge of the cartridge 16 causes the cartridge to move forwardly against the force of the spring 139 into proper position relative to the printhead 10 and other machine interface components. These include the interface between the cartridge drive roller 106 and corresponding machine drive roller 12 together with their respective gears 107 and 38. It also results in proper interface relationship between the cut-off drive arm 14 and the cut-off blade mount 120.

During this forward movement of the cartridge 16, the alignment pins 87, 87 in the printhead 10 engage the alignment openings 98 and 99 in the guide member 52 to properly align the guide member 52 relative to the printhead element 20. Upon initiation of a print or transfer cycle, the platen 11 moves forwardly as a result of actuation of the linear actuator 170 and forward pivoting of the arm 24 so that its shaft 26 engages and is aligned by the openings 96 within the yokes 95. The printing or transfer cycle then occurs. During such cycle, the drive rollers 106 and 112 are rotated to advance the tape 13 and ribbon 17. After the transfer step, the tape 13 exits the cartridge through the opening 116 in the side wall 60 of the cartridge, while the spent ribbon is pulled from the tape and is returned to the rewind spool 58. When it is desired to cut off a portion of the tape on which the printing or transfer has been completed, an appropriate cut-off button is depressed on the machine. This causes actuation of the cut-off arm 14, thereby driving the blade mount 120 and the blade 119 in a forward direction to sever the tape.

When the printhead 10 is deactivated, the platen 11 is moved rearwardly so that it is out of engagement with the printhead. To remove the cartridge from the machine, the cover 146 of the service tray 15 is opened. This permits rearward movement of the cartridge as a result of the rearward force of the spring 139. The cartridge can then be manually removed from the tray 15.

Although the description of the preferred embodiment has been quite specific, it is contemplated that various changes could be made without deviating from the spirit of the present invention. Accordingly, it is intended that the scope of the present invention be dictated by the appended claims rather than by the description of the preferred embodiment.

We claim:

1. A tape-ribbon supply system for a thermal transfer device or the like of the type having a device housing and a transfer station comprising a printhead and a platen for transfering a selected image from a ribbon to a tape, said tape-ribbon alignment and delivery system comprising:

a tape-ribbon cartridge having a supply of tape and a supply of ribbon;

a tape-ribbon cartridge receiving tray connected to said device housing, said cartridge receiving tray including a cartridge receiving cavity for receiving said tape-ribbon cartridge, each of said tape-ribbon cartridge and said receiving tray including an opening to receive said printhead and platen;

means for moving said cartridge, after insertion of said cartridge into said receiving tray, in a forward direction into a transfer alignment position relative to said transfer station, said means including a receiving tray cover pivotally secured to a portion of said receiving tray and pivotable between an open and a closed position and a cam means associated with said cover and engaging said cartridge whereby said cartridge is moved into transfer alignment as a result of pivoting said cover to a closed position; and means for retaining said cartridge in said transfer alignment position.

2. The system of claim 1 wherein said cam means includes a pair of cam rollers rotatably secured to a portion of said tray cover portion.

3. The system of claim 2 wherein said cartridge includes a forward and a rearward end and said pair of cam rollers engage said rearward end.

4. The system of claim 1 wherein said cartridge receiving tray is connected with said device housing in a fixed position.

5. The system of claim 1 including spring means for biasing said cartridge in a rearward direction away from said transfer alignment position.

6. The system of claim 5 wherein said spring means is connected with a portion of said device housing.

7. The system of claim 1 wherein said means for retaining said cartridge in said tranfer alignment position includes a retaining tab opening in the bottom of said cartridge and a retaining tab member connected with the base of said cartridge receiving tray, whereby said retaining tab member extends through said retaining tab opening.

8. The system of claim 7 wherein said retaining tab includes a retaining portion for securing engagement with said cartridge when said cartridge is in said transfer alignment position.

9. The system of claim 1 wherein said supply of tape includes a hub and wherein the bottom of said cartridge includes a first tape sensing opening and said cartridge receiving tray includes a tape sensing switch, said switch extending through said first tape sensing opening for engagement with said hub for the purpose of detecting the width of tape within said cartridge.

10. The system of claim 1 wherein the bottom of said cartridge includes a second tape sensing opening and said cartridge receiving tray includes a tape sensing means, said tape sensing means extending through said second tape sensing opening for the purpose of sensing the existence or absence of tape in said cartridge.

11. The system of claim 10 wherein said tape sensing means is slidably mounted to said cartridge receiving tray for movement with said cartridge.

* * * * *